US010502483B2

(12) United States Patent
Gushanas et al.

(10) Patent No.: US 10,502,483 B2
(45) **Date of Patent: *Dec. 10, 2019**

(54) INTEGRATED PRE-COOLED MIXED REFRIGERANT SYSTEM AND METHOD

(71) Applicant: Chart Energy & Chemicals, Inc., The Woodlands, TX (US)

(72) Inventors: Timothy P. Gushanas, Pearland, TX (US); Douglas A. Ducote, Jr., The Woodlands, TX (US); James Podolski, The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 296 days.

This patent is subject to a terminal disclaimer.

(21) Appl. No.: 15/345,957

(22) Filed: Nov. 8, 2016

(65) Prior Publication Data

US 2017/0051968 A1 Feb. 23, 2017

Related U.S. Application Data

(60) Continuation of application No. 15/227,235, filed on Aug. 3, 2016, which is a division of application No.

(Continued)

(51) Int. Cl.
*F25J 1/02* (2006.01)
*F25J 1/00* (2006.01)

(52) U.S. Cl.
CPC ..... *F25J 1/0218* (2013.01); *F25J 1/0012* (2013.01); *F25J 1/0015* (2013.01); *F25J 1/0022* (2013.01);

(Continued)

(58) Field of Classification Search
CPC ..... F25J 1/0279; F25J 1/0291; F25J 1/0214; F25J 1/0296
See application file for complete search history.

(56) References Cited

U.S. PATENT DOCUMENTS 2,041,725 A 7/1934 Podbielniak
3,364,685 A 1/1968 Perret (Continued)

FOREIGN PATENT DOCUMENTS

DE 19612173 C1 5/1997
DE 19937623 A1 2/2001

(Continued)

OTHER PUBLICATIONS

International Search Report and Written Opinion issued in PCT/US2011/027162 dated Mar. 3, 2011.

(Continued)

*Primary Examiner* — Tareq Alosh
(74) *Attorney, Agent, or Firm* — Cook Alex Ltd.; R. Blake Johnston

(57) ABSTRACT

A system and method for cooling and liquefying a gas in a heat exchanger that includes compressing and cooling a mixed refrigerant using first and last compression and cooling cycles so that high pressure liquid and vapor streams are formed. The high pressure liquid and vapor streams are cooled in the heat exchanger and then expanded so that a primary refrigeration stream is provided in the heat exchanger. The mixed refrigerant is cooled and equilibrated between the first and last compression and cooling cycles so that a pre-cool liquid stream is formed and subcooled in the heat exchanger. The stream is then expanded and passed through the heat exchanger as a pre-cool refrigeration stream. A stream of gas is passed through the heat exchanger in countercurrent heat exchange with the primary refrigeration stream and the pre-cool refrigeration stream so that the gas is cooled. A resulting vapor stream from the primary refrigeration stream passage and a two-phase stream from the pre-cool refrigeration stream passage exit the warm end of the exchanger and are combined and undergo a simulta- (Continued)

neous heat and mass transfer operation prior to the first compression and cooling cycle so that a reduced temperature vapor stream is provided to the first stage compressor so as to lower power consumption by the system. Additionally, the warm end of the cooling curve is nearly closed further reducing power consumption. Heavy components of the refrigerant are also kept out of the cold end of the process, reducing the possibility of refrigerant freezing, as well as facilitating a refrigerant management scheme.

20 Claims, 8 Drawing Sheets

Related U.S. Application Data

12/726,142, filed on Mar. 17, 2010, now Pat. No. 9,441,877.

(52) U.S. Cl.
CPC ..... *F25J 1/0055* (2013.01); *F25J 1/0212* (2013.01); *F25J 1/0214* (2013.01); *F25J 1/0216* (2013.01); *F25J 1/0217* (2013.01); *F25J 1/0279* (2013.01); *F25J 1/0291* (2013.01); *F25J 1/0292* (2013.01); *F25J 1/0297* (2013.01); *F25J 2205/02* (2013.01); *F25J 2205/90* (2013.01); *F25J 2220/62* (2013.01); *F25J 2220/64* (2013.01); *F25J 2235/02* (2013.01); *F25J 2270/60* (2013.01); *F25J 2270/66* (2013.01)

(56) References Cited

U.S. PATENT DOCUMENTS

| | | | | |
|---|---|---|---|---|
| 4,033,735 | A | 7/1977 | Swenson | |
| 4,057,972 | A | 11/1977 | Sarsten | |
| 4,274,849 | A | 6/1981 | Garier et al. | |
| 4,525,185 | A | 6/1985 | Newton | |
| 4,545,795 | A | 10/1985 | Liu et al. | |
| 4,586,942 | A | 5/1986 | Gauthier | |
| 4,689,063 | A | 8/1987 | Paradowski et al. | |
| 4,856,942 | A | 8/1989 | Bernadic et al. | |
| 4,901,533 | A | 2/1990 | Fan et al. | |
| 5,644,931 | A * | 7/1997 | Ueno | F25J 1/0022 62/612 |
| 5,718,126 | A | 2/1998 | Capron et al. | |
| 5,746,066 | A | 5/1998 | Manley | |
| 5,813,250 | A | 9/1998 | Ueno et al. | |
| 5,950,450 | A | 9/1999 | Bowen et al. | |
| 6,041,619 | A | 3/2000 | Fischer et al. | |
| 6,065,305 | A | 5/2000 | Arman et al. | |
| 6,250,105 | B1 * | 6/2001 | Kimble | F25J 1/0022 62/613 |
| 6,334,334 | B1 | 1/2002 | Stockmann et al. | |
| 6,347,531 | B1 | 2/2002 | Roberts et al. | |
| 2007/0227185 | A1 | 10/2007 | Stone et al. | |
| 2007/0283718 | A1 | 12/2007 | Hulsey et al. | |
| 2009/0205366 | A1 | 8/2009 | Schmidt | |
| 2009/0241593 | A1 | 10/2009 | Jager et al. | |
| 2011/0219819 | A1 | 9/2011 | Bauer et al. | |
| 2011/0226008 | A1 | 9/2011 | Gushanas et al. | |

FOREIGN PATENT DOCUMENTS

| | | | |
|---|---|---|---|
| DE | 10209799 | | 9/2003 |
| DE | 10194530 | | 10/2007 |
| DE | 102010011052 | | 9/2011 |
| DE | 102011104725 | | 12/2012 |
| EP | 008823 | | 3/1980 |
| EP | 0644996 | A1 | 10/1994 |
| EP | 0768502 | | 4/1997 |
| EP | 0975923 | A1 | 2/2000 |
| EP | 1016842 | A2 | 7/2000 |
| EP | 1092930 | A1 | 4/2001 |
| EP | 1092931 | A1 | 4/2001 |
| EP | 1118827 | A1 | 7/2001 |
| EP | 1144928 | A2 | 10/2001 |
| EP | 2399091 | A1 | 12/2001 |
| EP | 0990108 | B1 | 9/2002 |
| EP | 1248935 | A1 | 10/2002 |
| EP | 1137902 | B1 | 1/2003 |
| EP | 1273860 | A2 | 1/2003 |
| EP | 1306632 | A1 | 5/2003 |
| EP | 1309973 | A2 | 5/2003 |
| EP | 1352209 | A1 | 10/2003 |
| EP | 1397629 | A1 | 3/2004 |
| EP | 1092932 | B1 | 12/2004 |
| EP | 1092933 | B1 | 12/2004 |
| EP | 1304535 | B1 | 2/2005 |
| EP | 1455152 | B1 | 7/2005 |
| EP | 1323994 | B1 | 10/2005 |
| EP | 1281033 | B1 | 2/2006 |
| EP | 1668300 | A1 | 6/2006 |
| EP | 1774234 | | 4/2007 |
| EP | 1709923 | A1 | 5/2007 |
| EP | 1812760 | A2 | 8/2007 |
| EP | 1864062 | A1 | 12/2007 |
| EP | 1881283 | A2 | 1/2008 |
| EP | 1929227 | A1 | 6/2008 |
| EP | 1946026 | A2 | 7/2008 |
| EP | 2005056 | A2 | 12/2008 |
| EP | 2052197 | A2 | 4/2009 |
| EP | 2074364 | A2 | 7/2009 |
| EP | 2092257 | A2 | 8/2009 |
| EP | 2110630 | A2 | 10/2009 |
| EP | 1456589 | B1 | 1/2010 |
| EP | 2165138 | A2 | 3/2010 |
| EP | 2185877 | A1 | 5/2010 |
| EP | 2199716 | A2 | 6/2010 |
| EP | 2212402 | A1 | 8/2010 |
| EP | 2229566 | A1 | 9/2010 |
| EP | 2251625 | A2 | 11/2010 |
| EP | 2366085 | A2 | 9/2011 |
| EP | 1613910 | B1 | 2/2012 |
| EP | 2547972 | A1 | 1/2013 |
| EP | 2550496 | A2 | 1/2013 |
| EP | 2562501 | A2 | 2/2013 |
| EP | 1613909 | B1 | 3/2013 |
| EP | 2600088 | A2 | 6/2013 |
| FR | 2764972 | | 12/1998 |
| FR | 2841330 | | 12/2003 |
| FR | 28885673 | | 11/2006 |
| FR | 2891900 | A1 | 4/2007 |
| GB | 1122860 | | 8/1968 |
| GB | 2326465 | A | 12/1998 |
| GB | 278711 | A | 7/2012 |
| JP | H8-159652 | | 6/1996 |
| JP | H9-113129 | | 5/1997 |
| JP | 2002-0508055 | | 3/2002 |
| JP | 2002-0532674 | | 10/2002 |
| WO | WO 94/24500 | | 10/1994 |
| WO | WO 98/48227 | | 10/1998 |
| WO | WO 00/36350 | | 6/2000 |
| WO | WO 01/39200 | A2 | 5/2001 |
| WO | WO 01/044735 | | 6/2001 |
| WO | WO 02/29337 | A1 | 4/2002 |
| WO | WO 02/050483 | A1 | 6/2002 |
| WO | WO 02/101307 | A1 | 12/2002 |
| WO | WO 03/074955 | | 9/2003 |
| WO | WO 2005/028976 | A1 | 3/2005 |
| WO | WO 2006/007278 | | 1/2006 |
| WO | WO 2006/009610 | A2 | 1/2006 |
| WO | WO 2006/047098 | A2 | 5/2006 |
| WO | WO 2006/094675 | | 9/2006 |
| WO | WO 2006/120127 | A2 | 11/2006 |
| WO | WO 2007/021351 | | 2/2007 |
| WO | WO 2007/042662 | | 4/2007 |
| WO | WO 2007/120782 | A2 | 10/2007 |
| WO | WO 2008/006867 | | 1/2008 |
| WO | WO 2008/020044 | A2 | 2/2008 |

(56) References Cited

FOREIGN PATENT DOCUMENTS

| | | | |
|---|---|---|---|
| WO | WO 2008/034875 | | 3/2008 |
| WO | WO 2008/074718 | A2 | 6/2008 |
| WO | WO 2009/007435 | A2 | 1/2009 |
| WO | WO 2009/050178 | A2 | 4/2009 |
| WO | WO 2009/029142 | A1 | 5/2009 |
| WO | WO 2009/061777 | A1 | 5/2009 |
| WO | WO 2009-085937 | | 7/2009 |
| WO | WO 2010/058277 | A2 | 5/2010 |
| WO | WO 2010/096305 | A1 | 8/2010 |
| WO | WO 2010/133482 | A2 | 11/2010 |
| WO | WO 2011/115760 | | 9/2011 |
| WO | WO 2011/117655 | | 9/2011 |
| WO | WO 2012/023752 | A2 | 2/2012 |
| WO | WO 2012/075266 | A2 | 6/2012 |
| WO | WO 2012/112692 | | 8/2012 |
| WO | WO 2012/167007 | A1 | 12/2012 |
| WO | WO 2013/055305 | A1 | 4/2013 |
| WO | WO 2013/081979 | A1 | 6/2013 |
| WO | WO 2013/087570 | A2 | 6/2013 |
| WO | WO 2013/0875571 | A2 | 6/2013 |
| WO | WO 2014/116363 | A1 | 7/2014 |

OTHER PUBLICATIONS

International Search Report and Written Opinion issued in PCT/US2014/031135 dated Aug. 19, 2014.
Office Action issued in Mexican Application No. MX/a/2012/010726 dated Mar. 12, 2015.
Supplementary European Search Report issued in EP11756720 dated Jun. 1, 2015.

* cited by examiner

INTEGRATED PRE-COOLED MIXED REFRIGERANT SYSTEM AND METHOD

CLAIM OF PRIORITY

This application is a continuation application of prior application Ser. No. 15/227,235, filed Aug. 3, 2016, which is a divisional application of prior application Ser. No. 12/726,142, filed Mar. 17, 2010.

FIELD OF THE INVENTION

The present invention generally relates to processes and systems for cooling or liquefying gases and, more particularly, to an improved mixed refrigerant system and method for cooling or liquefying gases.

BACKGROUND

Natural gas, which is primarily methane, and other gases, are liquefied under pressure for storage and transport. The reduction in volume that results from liquefaction permits containers of more practical and economical design to be used. Liquefaction is typically accomplished by chilling the gas through indirect heat exchange by one or more refrigeration cycles. Such refrigeration cycles are costly both in terms equipment cost and operation due to the complexity of the required equipment and the required efficiency of performance of the refrigerant. There is a need, therefore, for gas cooling and liquefaction systems having improved refrigeration efficiency and reduced operating costs with reduced complexity.

Liquefaction of natural gas requires cooling of the natural gas stream to approximately −160° C. to −170° C. and then letting down the pressure to approximately ambient. FIG. 1 shows typical temperature—enthalpy curves for methane at 60 bar pressure, methane at 35 bar pressure and a mixture of methane and ethane at 35 bar pressure. There are three regions to the S-shaped curves. Above about −75° C. the gas is de-superheating and below about −90° C. the liquid is subcooling. The relatively flat region in-between is where the gas is condensing into liquid. Since the 60 bar curve is above the critical pressure, there is only one phase present; but its specific heat is large near the critical temperature, and the cooling curve is similar to the lower pressure curves. The curve containing 5% ethane shows the effect of impurities which round off the dew and bubble points.

A refrigeration process is necessary to supply the cooling for liquefying natural gas, and the most efficient processes will have heating curves which closely approach the cooling curves in FIG. 1 to within a few degrees throughout their entire range. However, because of the S-shaped form of the cooling curves and the large temperature range, such a refrigeration process is difficult to design. Because of their flat vaporization curves, pure component refrigerant processes work best in the two-phase region but, because of their sloping vaporization curves, multi-component refrigerant processes are more appropriate for the de-superheating and subcooling regions. Both types of processes, and hybrids of the two, have been developed for liquefying natural gas.

Cascaded, multilevel, pure component cycles were initially used with refrigerants such as propylene, ethylene, methane, and nitrogen. With enough levels, such cycles can generate a net heating curve which approximates the cooling curves shown in FIG. 1. However, the mechanical complexity becomes overwhelming as additional compressor trains are required as the number of levels increases. Such processes are also thermodynamically inefficient because the pure component refrigerants vaporize at constant temperature instead of following the natural gas cooling curve and the refrigeration valve irreversibly flashes liquid into vapor. For these reasons, improved processes have been sought in order to reduce capital cost, reduce energy consumption and improve operability.

U.S. Pat. No. 5,746,066 to Manley describes a cascaded, multilevel, mixed refrigerant process as applied to the similar refrigeration demands for ethylene recovery which eliminates the thermodynamic inefficiencies of the cascaded multilevel pure component process. This is because the refrigerants vaporize at rising temperatures following the gas cooling curve and the liquid refrigerant is subcooled before flashing thus reducing thermodynamic irreversibility. In addition, the mechanical complexity is somewhat less because only two different refrigerant cycles are required instead of the three or four required for the pure refrigerant processes. U.S. U.S. Pat. No. 4,525,185 to Newton; U.S. Pat. No. 4,545,795 to Liu et al.; U.S. Pat. No. 4,689,063 to Paradowski et al. and U.S. Pat. No. 6,041,619 to Fischer et al. all show variations on this theme applied to natural gas liquefaction as do U.S. Patent Application Publication Nos. 2007/0227185 to Stone et al. and 2007/0283718 to Hulsey et al.

The cascaded, multilevel, mixed refrigerant process is the most efficient known, but a simpler, efficient process which can be more easily operated is desirable for most plants.

U.S. Pat. No. 4,033,735 to Swenson describes a single mixed refrigerant process which requires only one compressor for the refrigeration process and which further reduces the mechanical complexity. However, for primarily two reasons, the process consumes somewhat more power than the cascaded, multilevel, mixed refrigerant process discussed above.

First, it is difficult, if not impossible, to find a single mixed refrigerant composition which will generate a net heating curve closely following the typical natural gas cooling curves shown in FIG. 1. Such a refrigerant must be constituted from a range of relatively high and low boiling components, and their boiling temperatures are thermodynamically constrained by the phase equilibrium. In addition, higher boiling components are limited because they must not freeze out at the lowest temperatures. For these reasons, relatively large temperature differences necessarily occur at several points in the cooling process. FIG. 2 shows typical composite heating and cooling curves for the process of the Swenson '735 patent.

Second, for the single mixed refrigerant process, all of the components in the refrigerant are carried to the lowest temperature level even though the higher boiling components only provide refrigeration at the warmer end of the refrigerated portion of the process. This requires energy to cool and reheat these components which are "inert" at the lower temperatures. This is not the case with either the cascaded, multilevel, pure component refrigeration process or the cascaded, multilevel, mixed refrigerant process.

To mitigate this second inefficiency and also address the first, numerous solutions have been developed which separate a heavier fraction from a single mixed refrigerant, use the heavier fraction at the higher temperature levels of refrigeration, and then recombine it with the lighter fraction for subsequent compression. U.S. Pat. No. 2,041,725 to Podbielniak describes one way of doing this which incorporates several phase separation stages at below ambient temperatures. U.S. Pat. No. 3,364,685 to Perret; U.S. Pat.

No. 4,057,972 to Sarsten, U.S. Pat. No. 4,274,849 to Garner et al.; U.S. Pat. No. 4,901,533 to Fan et al.; U.S. Pat. No. 5,644,931 to Ueno et al.; U.S. Pat. No. 5,813,250 to Ueno et al; U.S. Pat. No. 6,065,305 to Arman et al.; U.S. Pat. No. 6,347,531 to Roberts et al. and U.S. Patent Application Publication 2009/0205366 to Schmidt also show variations on this theme. When carefully designed they can improve energy efficiency even though the recombining of streams not at equilibrium is thermodynamically inefficient. This is because the light and heavy fractions are separated at high pressure and then recombined at low pressure so they may be compressed together in the single compressor. Whenever streams are separated at equilibrium, separately processed and then recombined at non-equilibrium conditions, a thermodynamic loss occurs which ultimately increases power consumption. Therefore the number of such separations should be minimized. All of these processes use simple vapor/liquid equilibrium at various places in the refrigeration process to separate a heavier fraction from a lighter one.

Simple one stage vapor/liquid equilibrium separation, however, doesn't concentrate the fractions as much as may be accomplished using multiple equilibrium stages with reflux. Greater concentration allows greater precision in isolating a composition which will provide refrigeration over a specific range of temperatures. This enhances the process ability to follow the S-shaped cooling curves in FIG. 1. U.S. Pat. No. 4,586,942 to Gauthier and U.S. Pat. No. 6,334,334 to Stockmann et al. describe how fractionation may be employed in the above ambient compressor train to further concentrate the separated fractions used for refrigeration in different temperature zones and thus improve the overall process thermodynamic efficiency. A second reason for concentrating the fractions and reducing their temperature range of vaporization is to ensure that they are completely vaporized when they leave the refrigerated part of the process. This fully utilizes the latent heat of the refrigerant and precludes the entrainment of liquids into downstream compressors. For this same reason heavy fraction liquids are normally re-injected into the lighter fraction of the refrigerant as part of the process. Fractionation of the heavy fractions reduces flashing upon re-injection and improves the mechanical distribution of the two phase fluids.

As illustrated by U.S. Patent Application Publication No. 2007/0227185 to Stone et al., it is known to remove partially vaporized refrigeration streams from the refrigerated portion of the process. Stone et al. does this for mechanical reasons (not thermodynamic) and in the context of a cascaded, multilevel, mixed refrigerant process requiring two, separate, mixed refrigerants. In addition, the partially vaporized refrigeration streams are completely vaporized upon recombination with their previously separated vapor fractions immediately prior to compression.

DETAILED DESCRIPTION OF EMBODIMENTS

In accordance with the invention, and as explained in greater detail below, simple equilibrium separation of a heavy fraction is sufficient to significantly improve the mixed refrigerant process efficiency if that heavy fraction isn't entirely vaporized as it leaves the primary heat exchanger of the process. This means that some liquid refrigerant will be present at the compressor suction and must beforehand be separated and pumped to a higher pressure. When the liquid refrigerant is mixed with the vaporized lighter fraction of the refrigerant, the compressor suction gas is greatly cooled and the required compressor power is further reduced. Equilibrium separation of the heavy fraction during an intermediate stage also reduces the load on the second or higher stage compressor(s), resulting in improved process efficiency. Heavy components of the refrigerant are also kept out of the cold end of the process, reducing the possibility of refrigerant freezing.

Figure 1:
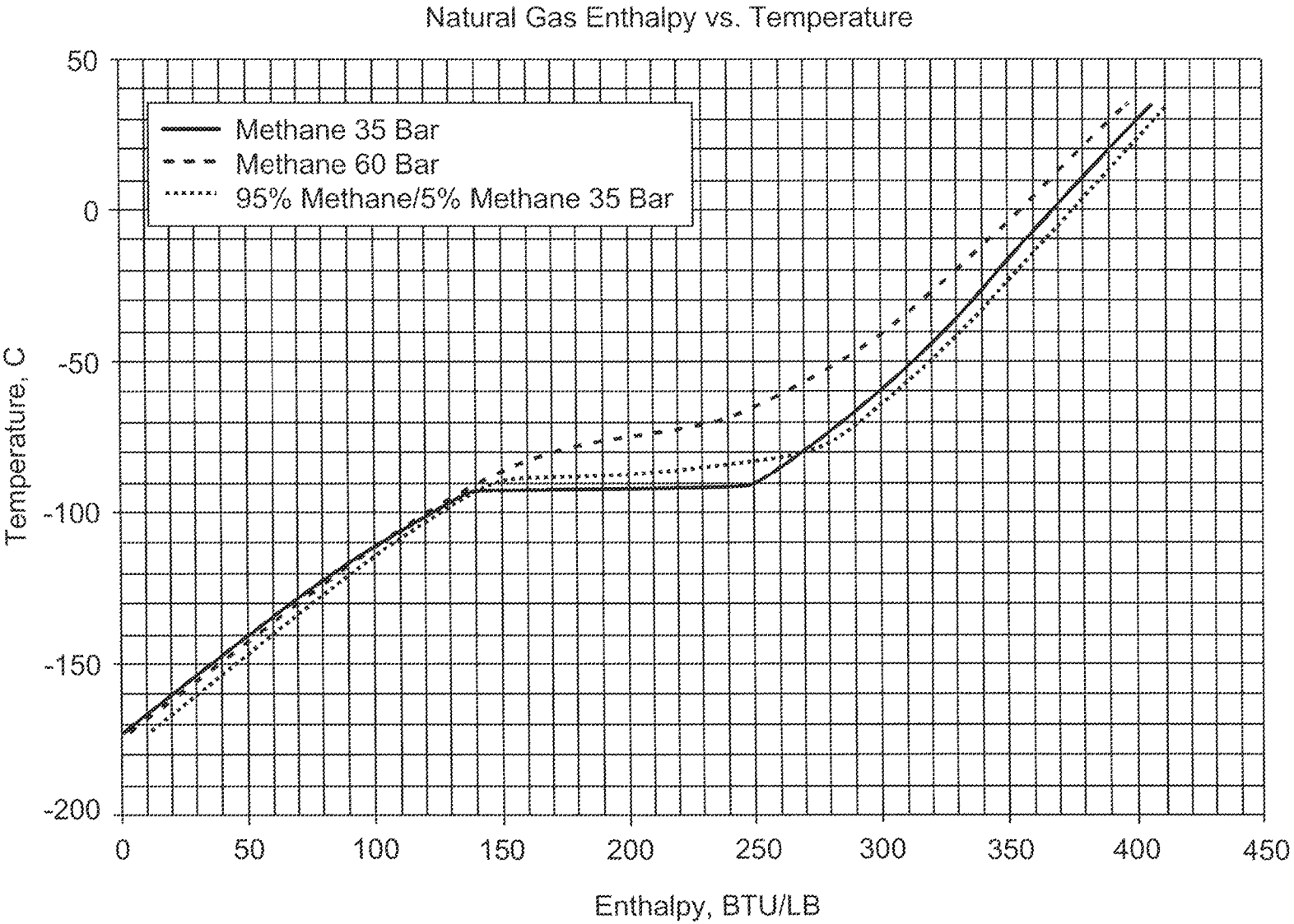
FIG. 1 is a graphical representation of temperature-enthalpy curves for methane at pressures of 35 bar and 60 bar and a mixture of methane and ethane at a pressure of 35 bar.
Figure 2:
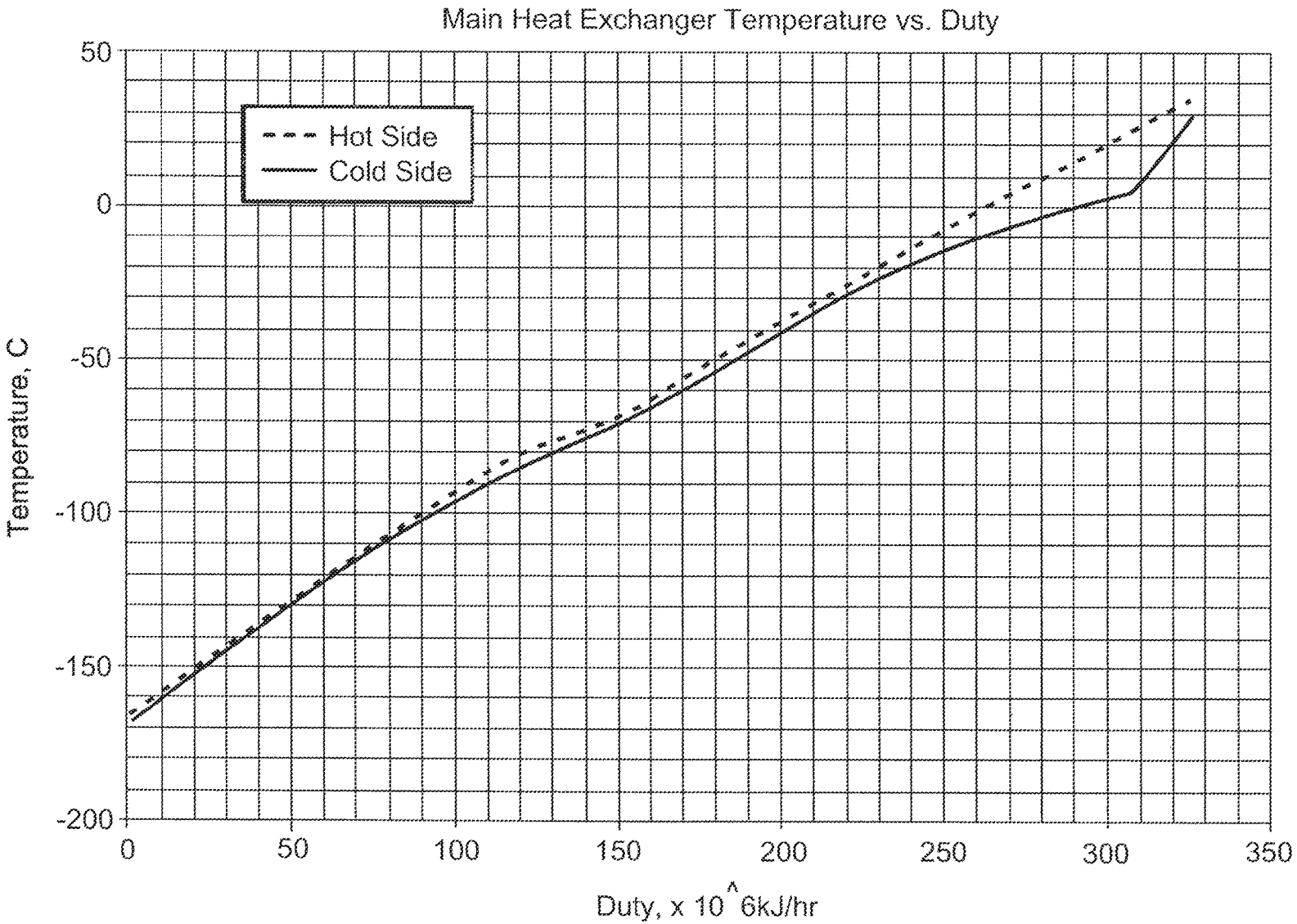
FIG. 2 is a graphical representation of the composite heating and cooling curves for a prior art process and system.
Figure 8:
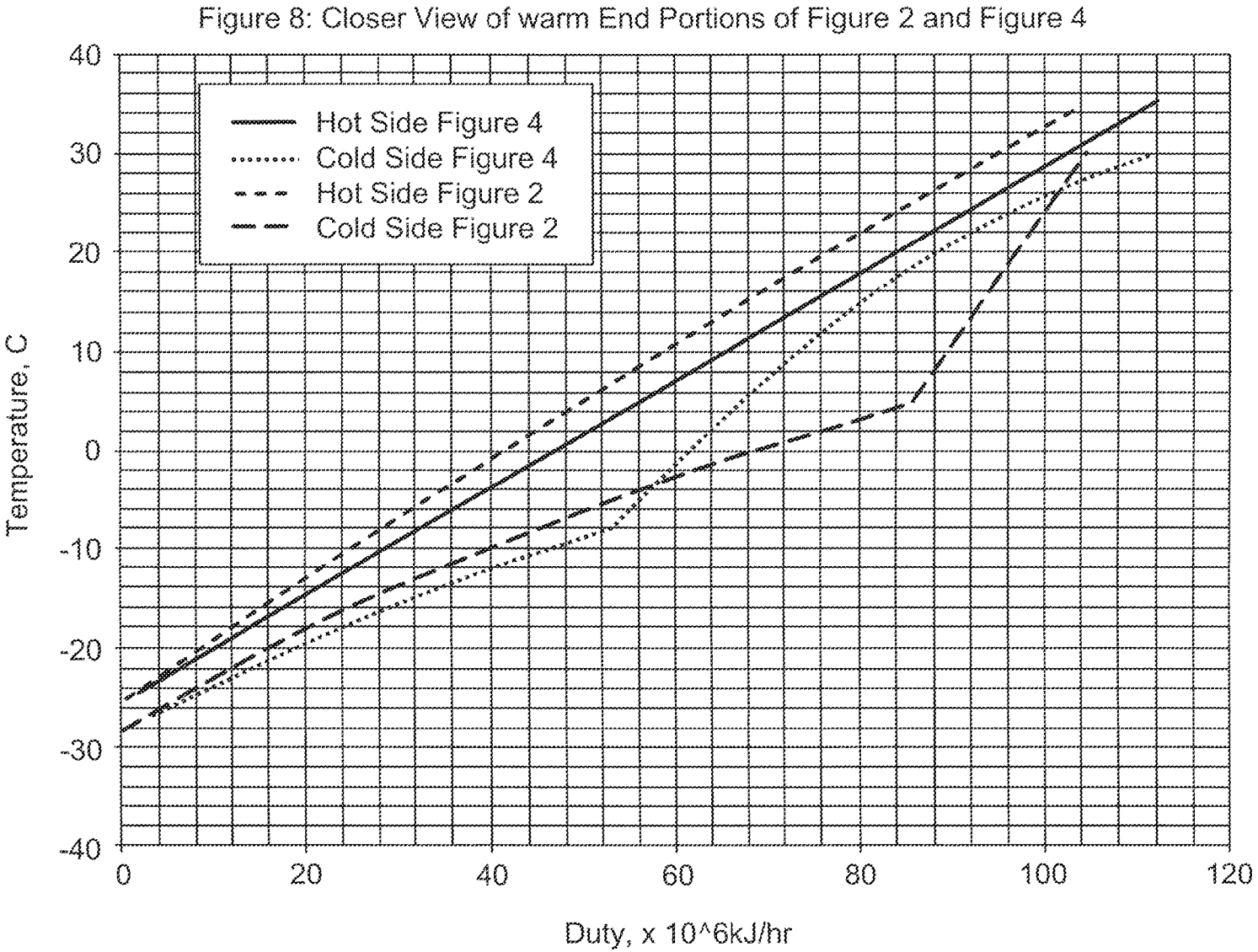
FIG. 8 is a graphical representation providing enlarged views of the warm end portions of the composite heating and cooling curves of FIGS. 2 and 4.

Furthermore, use of the heavy fraction in an independent pre-cool refrigeration loop results in near closure of heating/cooling curves at the warm end of the heat exchanger, giving a more efficient use of the refrigeration. This is best illustrated in FIG. 8 where the curves from FIGS. 2 (open curves) and 4 (closed curves) are plotted on the same axes with the temperature range limited to +40° C. to −40° C.

Figure 3:
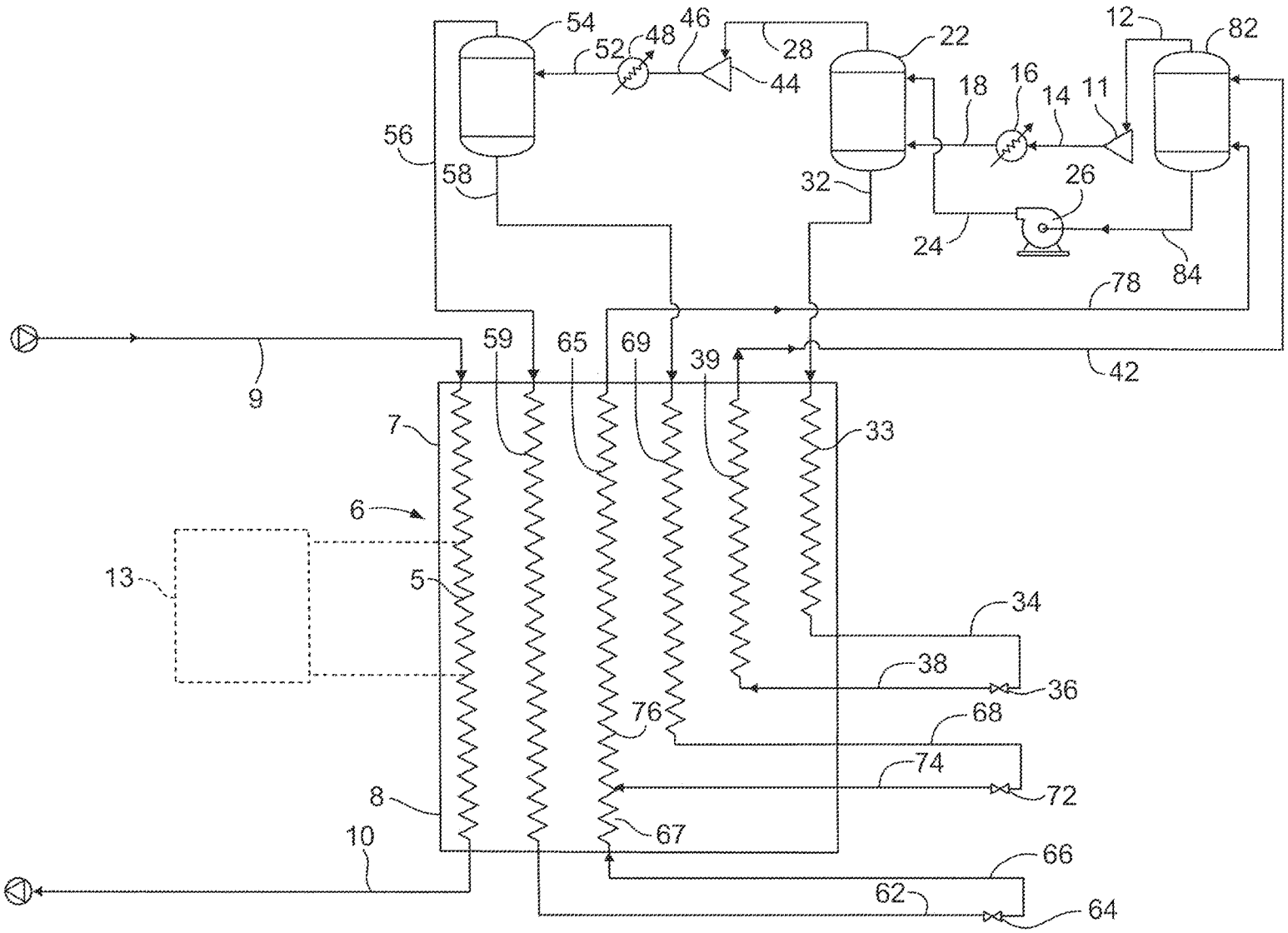
FIG. 3 is a process flow diagram and schematic illustrating an embodiment of the process and system of the invention.

A process flow diagram and schematic illustrating an embodiment of the system and method of the invention is provided in FIG. 3. Operation of the embodiment will now be described with reference to FIG. 3.

As illustrated in FIG. 3, the system includes a multi-stream heat exchanger, indicated in general at 6, having a warm end 7 and a cold end 8. The heat exchanger receives a high pressure natural gas feed stream 9 that is liquefied in cooling passage 5 via removal of heat via heat exchange with refrigeration streams in the heat exchanger. As a result, a stream 10 of liquid natural gas product is produced. The multi-stream design of the heat exchanger allows for convenient and energy-efficient integration of several streams into a single exchanger. Suitable heat exchangers may be purchased from Chart Energy & Chemicals, Inc. of The Woodlands, Texas. The plate and fin multi-stream heat exchanger available from Chart Energy & Chemicals, Inc. offers the further advantage of being physically compact.

The system of FIG. 3, including heat exchanger 6, may be configured to perform other gas processing options, indicated in phantom at 13, known in the prior art. These processing options may require the gas stream to exit and reenter the heat exchanger one or more times and may include, for example, natural gas liquids recovery or nitrogen rejection. Furthermore, while the system and method of the present invention are described below in terms of liquefaction of natural gas, they may be used for the cooling, liquefaction and/or processing of gases other than natural gas including, but not limited to, air or nitrogen.

The removal of heat is accomplished in the heat exchanger using a single mixed refrigerant and the remaining portion of the system illustrated in FIG. 3. The refrigerant compositions, conditions and flows of the streams of the refrigeration portion of the system, as described below, are presented in Table 1 below.

TABLE 1

Stream Table

| Stream Number | 9 | 10 | 12 | 14 | 18 |
|---|---|---|---|---|---|
| Temperature, ° C. | 35.0 | −165.7 | 4.8 | 90.5 | 35.0 |
| Pressure, BAR | 59.5 | 59.1 | 2.5 | 14.0 | 13.5 |
| Molar Rate, KGMOL/HR | 5,748 | 5,748 | 13,068 | 13,068 | 13,068 |
| Mass Rate, KG/HR | 92,903 | 92,903 | 478,405 | 478,405 | 478,405 |
| Liquid Mole Fraction | 0.0000 | 1.0000 | 0.0000 | 0.0000 | 0.1808 |
| Mole Percents | | | | | |
| NITROGEN | 1.00 | 1.00 | 9.19 | 9.19 | 9.19 |
| METHANE | 99.00 | 99.00 | 24.20 | 24.20 | 24.20 |
| ETHANE | 0.00 | 0.00 | 35.41 | 35.41 | 35.41 |
| PROPANE | 0.00 | 0.00 | 0.00 | 0.00 | 0.00 |
| N-BUTANE | 0.00 | 0.00 | 21.45 | 21.45 | 21.45 |
| ISOBUTANE | 0.00 | 0.00 | 0.00 | 0.00 | 0.00 |
| ISOPENTANE | 0.00 | 0.00 | 9.75 | 9.75 | 9.75 |

| Stream Number | 28 | 46 | 52 | 58 |
|---|---|---|---|---|
| Temperature, ° C. | 35.0 | 122.8 | 35.0 | 35.0 |
| Pressure, BAR | 13.5 | 50.0 | 49.5 | 49.5 |
| Molar Rate, KGMOL/HR | 10,699 | 10,699 | 10,699 | 3,157 |
| Mass Rate, KG/HR | 341,702 | 341,702 | 341,702 | 137,246 |
| Liquid Mole Fraction | 0.0000 | 0.0000 | 0.2951 | 1.0000 |
| Mole Percents | | | | |
| NITROGEN | 11.15 | 11.15 | 11.15 | 2.12 |
| METHANE | 29.03 | 29.03 | 29.03 | 11.37 |
| ETHANE | 40.08 | 40.08 | 40.08 | 39.05 |
| PROPANE | 0.00 | 0.00 | 0.00 | 0.00 |
| N-BUTANE | 15.20 | 15.20 | 15.20 | 35.14 |
| ISOBUTANE | 0.00 | 0.00 | 0.00 | 0.00 |
| ISOPENTANE | 4.53 | 4.53 | 4.53 | 12.31 |

| Stream Number | 68 | 74 | 84 | 24 | 32 |
|---|---|---|---|---|---|
| Temperature, ° C. | −134.1 | −132.8 | 4.8 | 5.6 | 35.0 |
| Pressure, BAR | 49.3 | 2.8 | 2.5 | 13.5 | 13.5 |
| Molar Rate, KGMOL/HR | 3,156 | 3,156 | 21 | 21 | 2,390 |
| Mass Rate, KG/HR | 137,183 | 137,183 | 1,317 | 1,317 | 138,020 |
| Liquid Mole Fraction | 1.0000 | 0.9821 | 1.0000 | 1.0000 | 1.0000 |
| Mole Percents | | | | | |
| NITROGEN | 2.12 | 2.12 | 0.04 | 0.04 | 0.32 |
| METHANE | 11.37 | 11.37 | 0.43 | 0.43 | 2.35 |
| ETHANE | 39.05 | 39.05 | 4.14 | 4.14 | 14.24 |
| PROPANE | 0.00 | 0.00 | 0.00 | 0.00 | 0.00 |
| N-BUTANE | 35.14 | 35.14 | 42.13 | 42.13 | 49.63 |
| ISOBUTANE | 0.00 | 0.00 | 0.00 | 0.00 | 0.00 |
| ISOPENTANE | 12.31 | 12.31 | 53.25 | 53.25 | 33.47 |

| Stream Number | 34 | 38 | 42 | 56 |
|---|---|---|---|---|
| Temperature, ° C. | −79.2 | −78.7 | 30.0 | 35.0 |
| Pressure, BAR | 13.3 | 2.8 | 2.6 | 49.5 |
| Molar Rate, KGMOL/HR | 2,391 | 2,391 | 2,391 | 7,541 |
| Mass Rate, KG/HR | 138,067 | 138,067 | 138,067 | 204,455 |
| Liquid Mole Fraction | 1.0000 | 1.0000 | 0.3891 | 0.0000 |
| Mole Percents | | | | |
| NITROGEN | 0.32 | 0.32 | 0.32 | 14.94 |
| METHANE | 2.35 | 2.35 | 2.35 | 36.43 |
| ETHANE | 14.24 | 14.24 | 14.24 | 40.51 |
| PROPANE | 0.00 | 0.00 | 0.00 | 0.00 |
| N-BUTANE | 49.63 | 49.63 | 49.63 | 6.84 |
| ISOBUTANE | 0.00 | 0.00 | 0.00 | 0.00 |
| ISOPENTANE | 33.46 | 33.46 | 33.46 | 1.28 |

| Stream Number | 62 | 66 | 67 | 76 | 78 |
|---|---|---|---|---|---|
| Temperature, ° C. | −165.7 | −169.7 | −128.6 | −128.5 | 30.0 |
| Pressure, BAR | 49.3 | 3.0 | 2.8 | 2.8 | 2.6 |

TABLE 1-continued

| Stream Table | | | | | |
|---|---|---|---|---|---|
| Molar Rate, KGMOL/HR | 7,542 | 7,542 | 7,542 | 10,698 | 10,698 |
| Mass Rate, KG/HR | 204,471 | 204,471 | 204,471 | 341,655 | 341,655 |
| Liquid Mole Fraction | 1.0000 | 0.9132 | 0.5968 | 0.7257 | 0.0000 |
| Mole Percents | | | | | |
| NITROGEN | 14.94 | 14.94 | 14.94 | 11.16 | 11.16 |
| METHANE | 36.43 | 36.43 | 36.43 | 29.04 | 29.04 |
| ETHANE | 40.51 | 40.51 | 40.51 | 40.08 | 40.08 |
| PROPANE | 0.00 | 0.00 | 0.00 | 0.00 | 0.00 |
| N-BUTANE | 6.84 | 6.84 | 6.84 | 15.19 | 15.19 |
| ISOBUTANE | 0.00 | 0.00 | 0.00 | 0.00 | 0.00 |
| ISOPENTANE | 1.28 | 1.28 | 1.28 | 4.53 | 4.53 |

With reference to the upper right portion of FIG. 3, a first stage compressor 11 receives a low pressure vapor refrigerant stream 12 and compresses it to an intermediate pressure. The stream 14 then travels to a first stage after-cooler 16 where it is cooled. After-cooler 16 may be, as an example, a heat exchanger. The resulting intermediate pressure mixed phase refrigerant stream 18 travels to interstage drum 22. While an interstage drum 22 is illustrated, alternative separation devices may be used, including, but not limited to, another type of vessel, a cyclonic separator, a distillation unit, a coalescing separator or mesh or vane type mist eliminator. Interstage drum 22 also receives an intermediate pressure liquid refrigerant stream 24 which, as will be explained in greater detail below, is provided by pump 26. In an alternative embodiment, stream 24 may instead combine with stream 14 upstream of after-cooler 16 or stream 18 downstream of after-cooler 16.

Streams 18 and 24 are combined and equilibrated in interstage drum 22 which results in separated intermediate pressure vapor stream 28 exiting the vapor outlet of the drum 22 and intermediate pressure liquid stream 32 exiting the liquid outlet of the drum. Intermediate pressure liquid stream 32, which is warm and a heavy fraction, exits the liquid side of drum 22 and enters pre-cool liquid passage 33 of heat exchanger 6 and is subcooled by heat exchange with the various cooling streams, described below, also passing through the heat exchanger. The resulting stream 34 exits the heat exchanger and is flashed through expansion valve 36. As an alternative to the expansion valve 36, another type of expansion device could be used, including, but not limited to, a turbine or an orifice. The resulting stream 38 reenters the heat exchanger 6 to provide additional refrigeration via pre-cool refrigeration passage 39. Stream 42 exits the warm end 7 of the heat exchanger as a two-phase mixture with a significant liquid fraction.

Intermediate pressure vapor stream 28 travels from the vapor outlet of drum 22 to second or last stage compressor 44 where it is compressed to a high pressure. Stream 46 exits the compressor 44 and travels through second or last stage after-cooler 48 where it is cooled. The resulting stream 52 contains both vapor and liquid phases which are separated in accumulator drum 54. While an accumulator drum 54 is illustrated, alternative separation devices may be used, including, but not limited to, another type of vessel, a cyclonic separator, a distillation unit, a coalescing separator or mesh or vane type mist eliminator. High pressure vapor refrigerant stream 56 exits the vapor outlet of drum 54 and travels to the warm side of the heat exchanger 6. High pressure liquid refrigerant stream 58 exists the liquid outlet of drum 54 and also travels to the warm end of the heat exchanger 6. It should be noted that first stage compressor 11 and first stage after-cooler 16 make up a first compression and cooling cycle while last stage compressor 44 and last stage after-cooler 48 make up a last compression and cooling cycle. It should also be noted, however, that each cooling cycle stage could alternatively features multiple compressors and/or after-coolers.

Warm, high pressure, vapor refrigerant stream 56 is cooled, condensed and subcooled as it travels through high pressure vapor passage 59 of the heat exchanger 6. As a result, stream 62 exits the cold end of the heat exchanger 6. Stream 62 is flashed through expansion valve 64 and re-enters the heat exchanger as stream 66 to provide refrigeration as stream 67 traveling through primary refrigeration passage 65. As an alternative to the expansion valve 64, another type of expansion device could be used, including, but not limited to, a turbine or an orifice.

Warm, high pressure liquid refrigerant stream 58 enters the heat exchanger 6 and is subcooled in high pressure liquid passage 69. The resulting stream 68 exits the heat exchanger and is flashed through expansion valve 72. As an alternative to the expansion valve 72, another type of expansion device could be used, including, but not limited to, a turbine or an orifice. The resulting stream 74 re-enters the heat exchanger 6 where it joins and is combined with stream 67 in primary refrigeration passage 65 to provide additional refrigeration as stream 76 and exit the warm end of the heat exchanger 6 as a superheated vapor stream 78.

Superheated vapor stream 78 and stream 42 which, as noted above, is a two-phase mixture with a significant liquid fraction, enter low pressure suction drum 82 through vapor and mixed phase inlets, respectively, and are combined and equilibrated in the low pressure suction drum. While a suction drum 82 is illustrated, alternative separation devices may be used, including, but not limited to, another type of vessel, a cyclonic separator, a distillation unit, a coalescing separator or mesh or vane type mist eliminator. As a result, a low pressure vapor refrigerant stream 12 exits the vapor outlet of drum 82. As stated above, the stream 12 travels to the inlet of the first stage compressor 11. The blending of mixed phase stream 42 with stream 78, which includes a vapor of greatly different composition, in the suction drum 82 at the suction inlet of the compressor 11 creates a partial flash cooling effect that lowers the temperature of the vapor stream traveling to the compressor, and thus the compressor itself, and thus reduces the power required to operate it.

A low pressure liquid refrigerant stream 84, which has also been lowered in temperature by the flash cooling effect of mixing, exits the liquid outlet of drum 82 and is pumped to intermediate pressure by pump 26. As described above, the outlet stream 24 from the pump travels to the interstage drum 22.

As a result, in accordance with the invention, a pre-cool refrigerant loop, which includes streams 32, 34, 38 and 42, enters the warm side of the heat exchanger 6 and exits with a significant liquid fraction. The partially liquid stream 42 is combined with spent refrigerant vapor from stream 78 for equilibration and separation in suction drum 82, compression of the resultant vapor in compressor 11 and pumping of the resulting liquid by pump 26. The equilibrium in suction drum 82 reduces the temperature of the stream entering the compressor 11, by both heat and mass transfer, thus reducing the power usage by the compressor.

Figure 4:
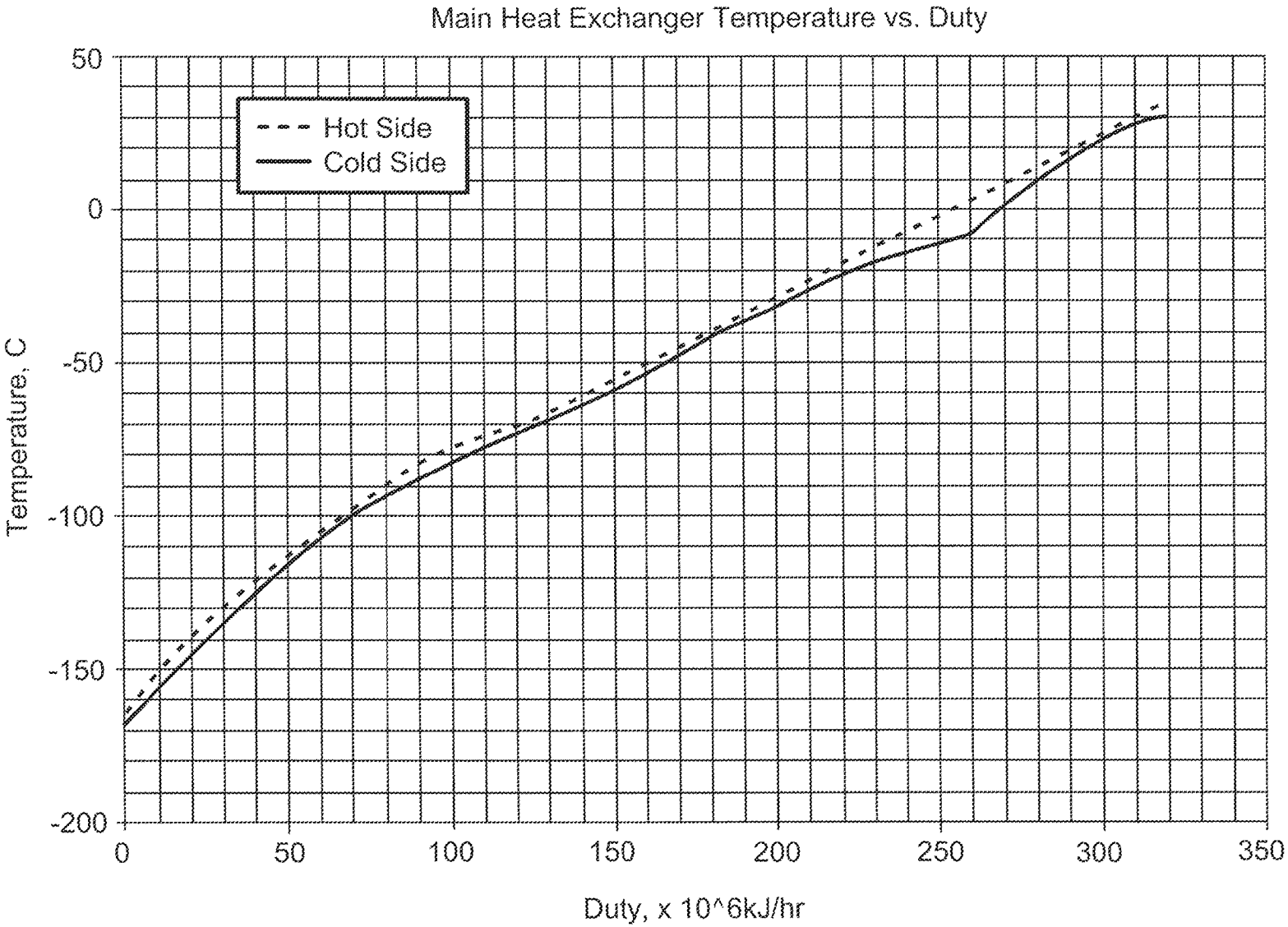
FIG. 4 is a graphical representation of composite heating and cooling curves for the process and system of FIG. 3

Composite heating and cooling curves for the process in FIG. 3 are shown in FIG. 4. Comparison with the curves of FIG. 2 for an optimized, single mixed refrigerant, process, similar to that described in U.S. Pat. No. 4,033,735 to Swenson, shows that the composite heating and cooling curves have been brought closer together thus reducing compressor power by about 5%. This helps reduce the capital cost of a plant and reduces energy consumption with associated environmental emissions. These benefits can result in several million dollars savings a year for a small to middle sized liquid natural gas plant.

FIG. 4 also illustrates that the system and method of FIG. 3 results in near closure of the heat exchanger warm end of the cooling curves (see also FIG. 8). This occurs because the intermediate pressure heavy fraction liquid boils at a higher temperature than the rest of the refrigerant and is thus well suited for the warm end heat exchanger refrigeration. Boiling the intermediate pressure heavy fraction liquid separately from the lighter fraction refrigerant in the heat exchanger allows for an even higher boiling temperature, which results in an even more "closed" (and thus more efficient) warm end of the curve. Furthermore, keeping the heavy fraction out of the cold end of the heat exchanger helps prevent the occurrence of freezing.

It should be noted that the embodiment described above is for a representative natural gas feed at supercritical pressure. The optimal refrigerant composition and operating conditions will change when liquefying other, less pure, natural gases at different pressures. The advantage of the process remains, however, because of its thermodynamic efficiency.

Figure 5:
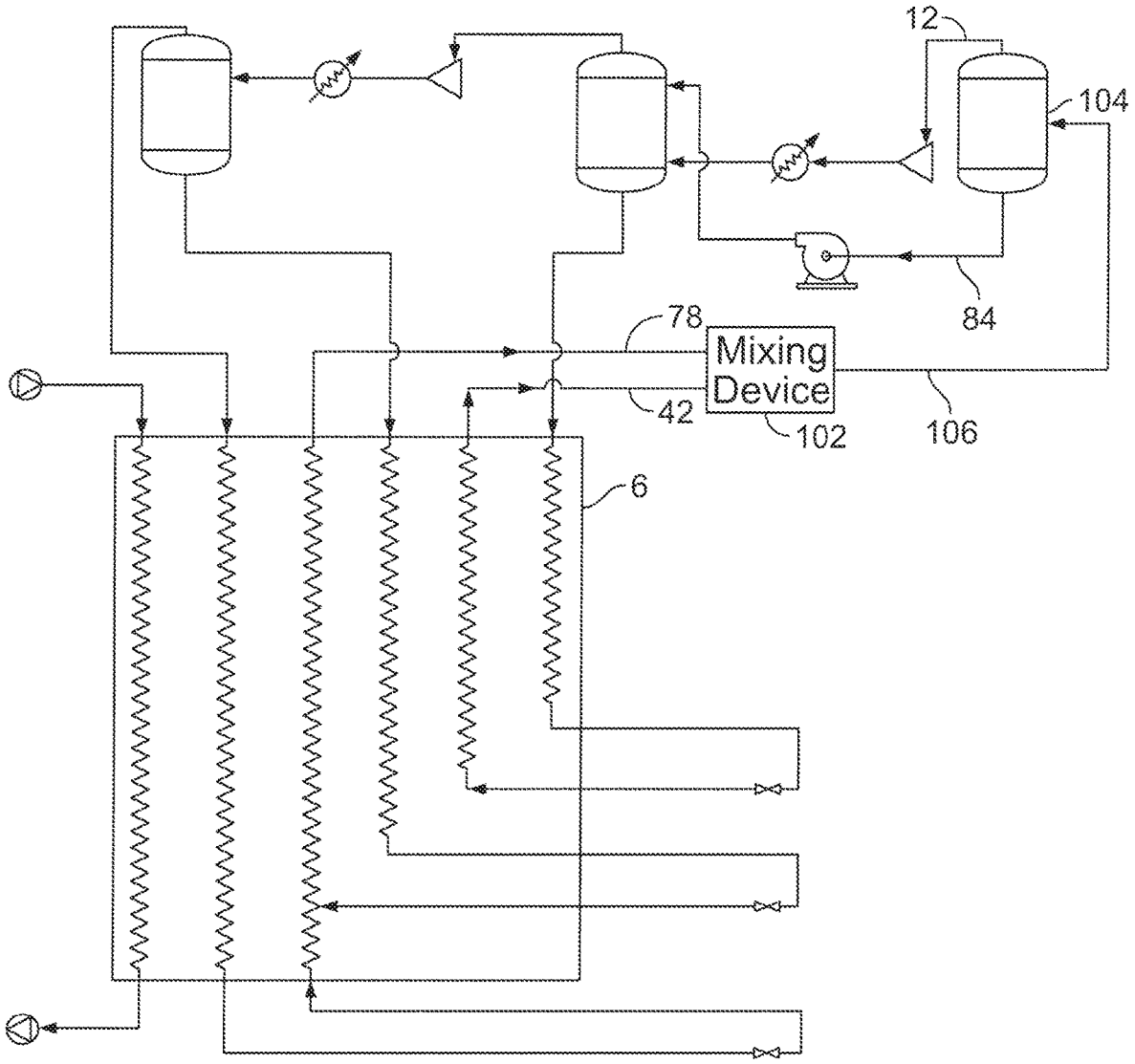
FIG. 5 is a process flow diagram and schematic illustrating a second embodiment of the process and system of the invention.

A process flow diagram and schematic illustrating a second embodiment of the system and method of the invention is provided in FIG. 5. In the embodiment of FIG. 5, the superheated vapor stream 78 and two-phase mixed stream 42 are combined in a mixing device, indicated at 102, instead of the suction drum 82 of FIG. 3. The mixing device 102 may be, for example, a static mixer, a single pipe segment into which streams 78 and 42 flow, packing or a header of the heat exchanger 6. After leaving mixing device 102, the combined and mixed streams 78 and 42 travel as stream 106 to a single inlet of the low pressure suction drum 104. While a suction drum 104 is illustrated, alternative separation devices may be used, including, but not limited to, another type of vessel, a cyclonic separator, a distillation unit, a coalescing separator or mesh or vane type mist eliminator. When stream 106 enters suction drum 104, vapor and liquid phases are separated so that a low pressure liquid refrigerant stream 84 exits the liquid outlet of drum 104 while a low pressure vapor stream 12 exits the vapor outlet of drum 104, as described above for the embodiment of FIG. 3. The remaining portion of the embodiment of FIG. 5 features the same components and operation as described for the embodiment of FIG. 3, although the data of Table 1 may differ.

Figure 6:
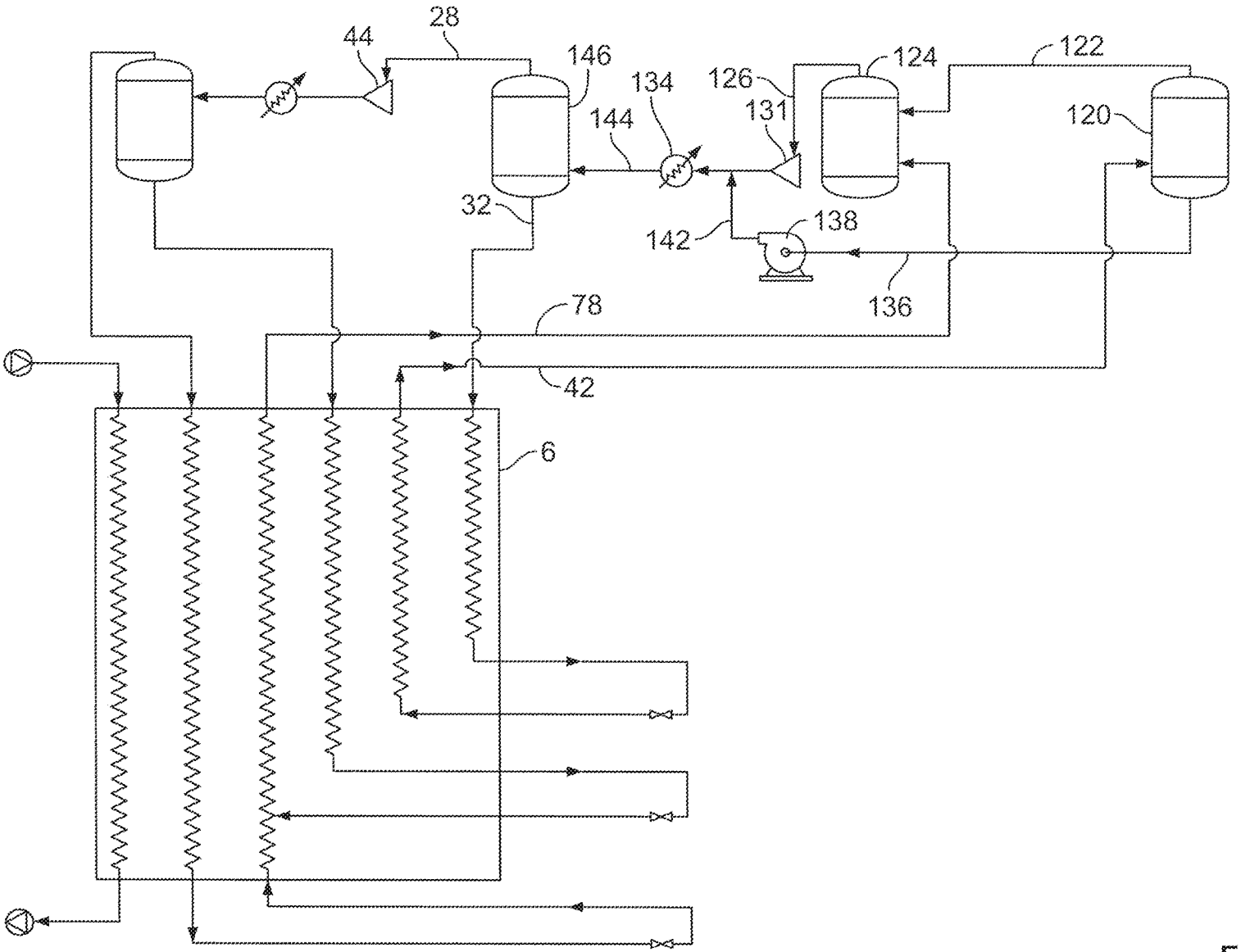
FIG. 6 is a process flow diagram and schematic illustrating a third embodiment of the process and system of the invention.

A process flow diagram and schematic illustrating a third embodiment of the system and method of the invention is provided in FIG. 6. In the embodiment of FIG. 6, the two-phase mixed stream 42 from the heat exchanger 6 travels to return drum 120. The resulting vapor phase travels as return vapor stream 122 to a first vapor inlet of low pressure suction drum 124. Superheated vapor stream 78 from the heat exchanger 6 travels to a second vapor inlet of low pressure suction drum 124. The combined stream 126 exits the vapor outlet of suction drum 124. The drums 120 and 124 may alternatively be combined into a single drum or vessel that performs the return separator drum and suction drum functions. Furthermore, alternative types of separation devices may be substituted for drums 120 and 124, including, but not limited to, another type of vessel, a cyclonic separator, a distillation unit, a coalescing separator or mesh or vane type mist eliminator.

A first stage compressor 131 receives the low pressure vapor refrigerant stream 126 and compresses it to an intermediate pressure. The compressed stream 132 then travels to a first stage after-cooler 134 where it is cooled. Meanwhile, liquid from the liquid outlet of return separator drum 120 travels as return liquid stream 136 to pump 138, and the resulting stream 142 then joins stream 132 upstream from the first stage after-cooler 134.

The intermediate pressure mixed phase refrigerant stream 144 leaving first stage after-cooler 134 travels to interstage drum 146. While an interstage drum 146 is illustrated, alternative separation devices may be used, including, but not limited to, another type of vessel, a cyclonic separator, a distillation unit, a coalescing separator or mesh or vane type mist eliminator. A separated intermediate pressure vapor stream 28 exits the vapor outlet of the interstage drum 146 and an intermediate pressure liquid stream 32 exits the liquid outlet of the drum. Intermediate pressure vapor stream 28 travels to second stage compressor 44, while intermediate pressure liquid stream 32, which is a warm and heavy fraction, travels to the heat exchanger 6, as described above with respect to the embodiment of FIG. 3. The remaining portion of the embodiment of FIG. 6 features the same components and operation as described for the embodiment of FIG. 3, although the data of Table 1 may differ. The embodiment of FIG. 6 does not provide any cooling at drum 124, and thus no cooling of the first stage compressor suction stream 126. In terms of improving efficiency, however, the cool compressor suction stream is traded for a reduced vapor molar flow rate to the compressor suction. The reduced vapor flow to the compressor suction provides a reduction in the compressor power requirement that is roughly equivalent to the reduction provided by the cooled compressor suction stream of the embodiment of FIG. 3. While there is an associated increase in the power requirement of pump 138, as compared to pump 26 in the embodiment of FIG. 3, the pump power increase is very small (approximately 1/100) compared to the savings in compressor power.

Figure 7:
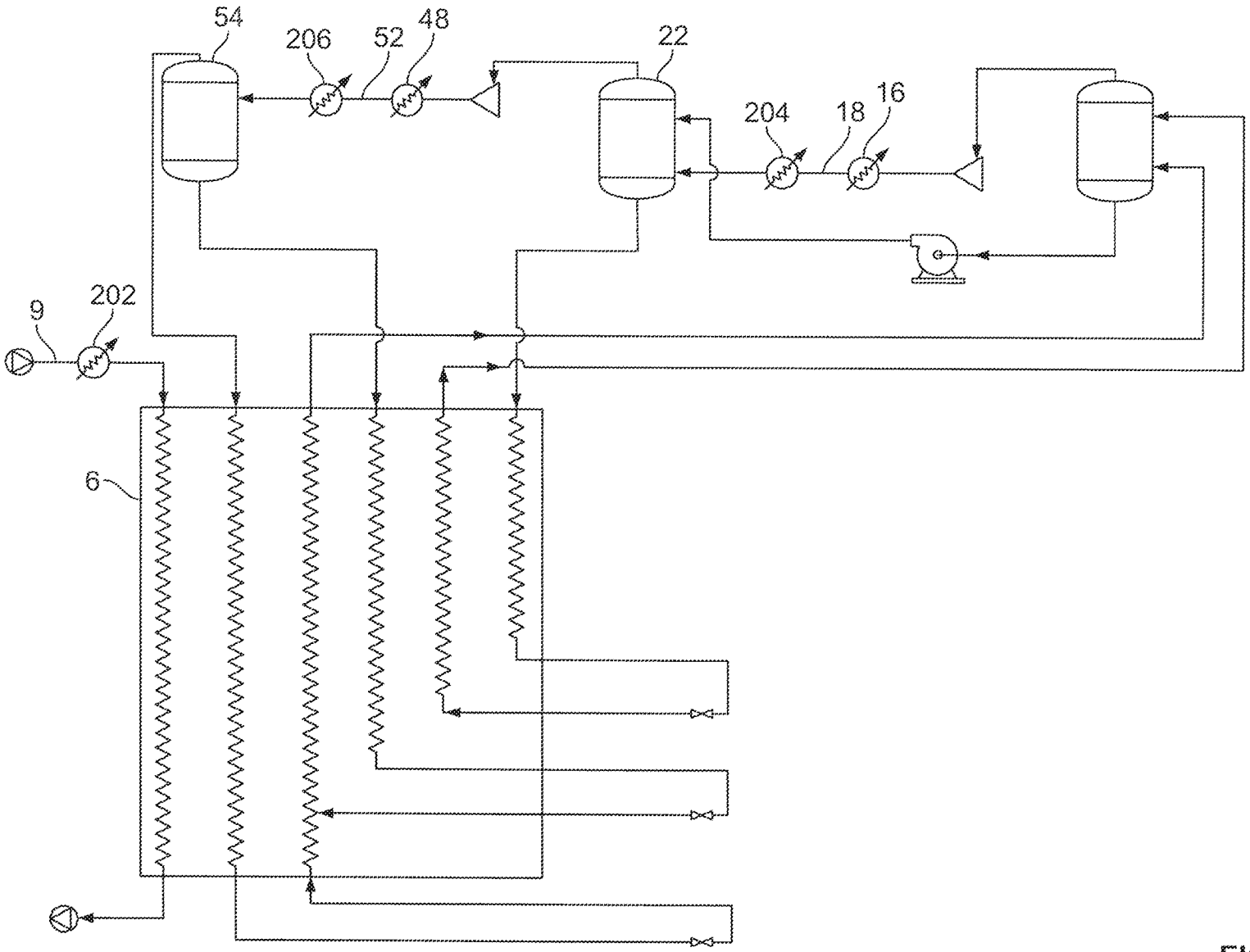
FIG. 7 is a process flow diagram and schematic illustrating a fourth embodiment of the process and system of the invention.

In a fourth embodiment of the system and method of the invention, illustrated in FIG. 7, the system of FIG. 3 is optionally provided with one or more pre-cooling systems, indicated at 202, 204 and/or 206. Of course the embodiments of FIG. 5 or 6, or any other embodiment of the system of the invention, could be provided with the pre-cooling systems of FIG. 7. Pre-cooling system 202 is for pre-cooling the natural gas stream 9 prior to heat exchanger 6. Pre-cooling system 204 is for interstage pre-cooling of mixed phase stream 18 as it travels from first stage after-cooler 16 to interstage drum 22. Pre-cooling system 206 is for discharge pre-cooling of mixed phase stream 52 as it travels to accumulator drum 54 from second stage after-cooler 48. The remaining portion of the embodiment of FIG. 7 features the same components and operation as described for the embodiment of FIG. 3, although the data of Table 1 may differ.

Each one of the pre-cooling systems 202, 204 or 206 could be incorporated into or rely on heat exchanger 6 for operation or could include a chiller that may be, for example, a second multi-stream heat exchanger. In addition, two or all three of the pre-cooling systems 202, 204 and/or 206 could be incorporated into a single multi-stream heat exchanger. While any pre-cooling system known in the art could be used, the pre-cooling systems of FIG. 7 each preferably includes a chiller that uses a single component refrigerant, such as propane, or a second mixed refrigerant as the pre-cooling system refrigerant. More specifically, the well-known propane C3-MR pre-cooling process or dual mixed refrigerant processes, with the pre-cooling refrigerant evaporated at either a single pressure or multiple pressures, could be used. Examples of other suitable single component refrigerants include, but are not limited to, N-butane, isobutane, propylene, ethane, ethylene, ammonia, freon or water.

In addition to being provided with a pre-cooling system 202, the system of FIG. 7 (or any of the other system embodiments) could serve as a pre-cooling system for a downstream process, such as a liquefaction system or a second mixed refrigerant system. The gas being cooled in the cooling passage of the heat exchanger also could be a second mixed refrigerant or a single component mixed refrigerant.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for cooling a gas with a mixed refrigerant including:

a) a heat exchanger including a warm end and a cold end, the warm end having a feed gas inlet adapted to receive a feed of the gas and the cold end having a product outlet through which product exits said heat exchanger, said heat exchanger also including a cooling passage in communication with the feed gas inlet and the product outlet, a pre-cool liquid passage, a pre-cool refrigeration passage, a high pressure passage and a primary refrigeration passage, said pre-cool refrigeration passage passing solely through the warm end of the heat exchanger and said primary refrigeration passage passing through both the cold end and the warm end of the heat exchanger;

b) a suction separation device having an inlet, a vapor outlet and a liquid outlet;

c) a first stage compressor having a suction inlet in fluid communication with the vapor outlet of the suction separation device and an outlet;

d) a first stage after-cooler having an inlet in fluid communication with the outlet of the first stage compressor and an outlet;

e) an interstage separation device having an inlet in fluid communication with the outlet of the first stage after-cooler and having a vapor outlet in fluid communication with the high pressure passage of the heat exchanger and a liquid outlet in fluid communication with the pre-cool liquid passage of the heat exchanger;

f) a first expansion device having an inlet in fluid communication with the pre-cool liquid passage of the heat exchanger and an outlet in communication with the pre-cool refrigeration passage of the heat exchanger;

g) a second expansion device having an inlet in fluid communication with the high pressure passage of the heat exchanger and an outlet in communication with the primary refrigeration passage of the heat exchanger;

h) said pre-cool refrigeration passage adapted to produce a mixed phase outlet stream that exits the pre-cool refrigeration passage through a pre-cool refrigeration passage outlet and said primary refrigeration passage adapted to produce a superheated vapor outlet stream that exits the primary refrigeration passage through a primary refrigeration passage outlet;

i) a mixing device, said mixing device having a vapor inlet in fluid communication with the primary refrigeration passage of the heat exchanger and a mixed phase inlet in communication with the pre-cool refrigeration passage of the heat exchanger so that the vapor stream from the primary refrigeration passage and the mixed phase stream from the pre-cool refrigeration passage are combined and mixed in the mixing device, said mixing device also having an outlet in communication with the inlet of the suction separation device so that the combined and mixed streams are provided to the suction separation device; and j) a pump having an inlet in fluid communication with the liquid outlet of the suction separation device and an outlet configured to bypass the first stage after-cooler and direct liquid to the interstage separation device.

2. The system of claim 1 wherein said interstage separation device is adapted to produce a liquid stream containing a heavy fraction of the refrigerant.

3. The system of claim 1 wherein the cooling passage and the high pressure passage pass through the warm and cold ends of the heat exchanger.

4. The system of claim 1 wherein the gas is natural gas.

5. The system of claim 4 wherein the product is liquefied natural gas.

6. The system of claim 1 wherein the product is liquefied gas.

7. The system of claim 1 further comprising a first pre-cooling system adapted to receive and cool the feed of the gas and direct the cooled gas to the gas feed inlet of the heat exchanger.

8. The system of claim 7 wherein the first pre-cooling system uses a single component refrigerant as a pre-cooling system refrigerant.

9. The system of claim 8 wherein the single component refrigerant is propane.

10. The system of claim 7 wherein the first pre-cooling system uses a second mixed refrigerant as a pre-cooling system refrigerant.

11. The system of claim 7 further comprising a second pre-cooling system in circuit between the outlet of the first stage compressor and the inlet of the interstage separation device.

12. The system of claim 11 wherein the first and second pre-cooling systems are included in a single pre-cooling system using a single pre-cool refrigerant.

13. The system of claim 1 further comprising a pre-cooling system in circuit between the outlet of the first stage compressor and the inlet of the interstage separation device.

14. The system of claim 13 wherein the pre-cooling system uses a single component refrigerant as a pre-cooling system refrigerant.

15. The system of claim 14 wherein the single component refrigerant is propane.

16. The system of claim 1 wherein the mixing device includes a pipe segment.

17. The system of claim 1 wherein the mixing device includes a header of the heat exchanger.

18. The system of claim 1 wherein the outlet of the first expansion device is configured to provide a mixed phase stream directly to the pre-cool refrigeration passage of the heat exchanger.

19. The system of claim 1 wherein the interstage separation device has a vapor inlet in fluid communication with the outlet of the first stage after-cooler and a liquid inlet in fluid communication with the outlet of the pump.

20. The system of claim 1 wherein the high pressure passage of the heat exchanger is a high pressure vapor passage and wherein the heat exchanger further includes a high pressure liquid passage and further comprising:

k) a second stage compressor having a suction inlet in fluid communication with the vapor outlet of the interstage separation device and an outlet;

l) a second stage after-cooler having an inlet in fluid communication with the outlet of the second stage compressor and an outlet;

m) an high pressure accumulator having a high pressure accumulator inlet in fluid communication with the outlet of the second stage after-cooler, said high pressure accumulator having a high pressure vapor outlet and a high pressure liquid outlet wherein the high pressure vapor outlet is in fluid communication with the high pressure vapor passage of the heat exchanger and the high pressure liquid outlet is in fluid communication with the high pressure liquid passage of the heat exchanger;

n) a third expansion device having an inlet in fluid communication with the high pressure liquid passage of the heat exchanger and an outlet in communication with the primary refrigeration passage of the heat exchanger.

* * * * *